United States Patent [19]

Perko

[11] Patent Number: 4,852,871

[45] Date of Patent: Aug. 1, 1989

[54] HAND EXERCISE DEVICE

[76] Inventor: John Perko, 11176 100th St. North, Largo, Fla. 34643

[21] Appl. No.: 279,433

[22] Filed: Dec. 2, 1988

[51] Int. Cl.[4] ..... A63B 21/00

[52] U.S. Cl. ..... 272/67; 272/136; 272/140

[58] Field of Search ..... 272/67, 68, 135, 136, 272/140, 93, DIG. 4, 901, 116; 128/26; 73/379, 380

[56] References Cited

U.S. PATENT DOCUMENTS

| | | | |
|---|---|---|---|
| 2,106,994 | 2/1938 | Chapman | 73/380 X |
| 2,132,862 | 10/1938 | Pilates | 73/380 X |
| 3,396,967 | 8/1968 | Brown | 272/67 |
| 3,666,267 | 5/1972 | McKinney | 272/67 |
| 3,717,338 | 2/1973 | Hughes | 272/67 |
| 3,830,493 | 8/1974 | Miller | 272/67 |
| 4,095,789 | 6/1978 | Mueller | 272/67 |
| 4,193,593 | 3/1980 | Wilson | 272/137 |
| 4,343,465 | 8/1982 | Allen | 272/67 |
| 4,392,649 | 7/1983 | Chapman | 272/67 |
| 4,591,151 | 5/1986 | Hensley | 272/140 |
| 4,643,417 | 2/1987 | Nieman | 272/67 |
| 4,695,049 | 9/1987 | Ciemiega | 272/67 |

*Primary Examiner*—Richard J. Apley
*Assistant Examiner*—H. Flaxman
*Attorney, Agent, or Firm*—Herbert W. Larson

[57] ABSTRACT

A tension spring is attached at each end to a pair of mounting brackets attached to a portable pedestal. The spring is enclosed in a cylindrical housing and one end of the spring is attached to the mounting bracket by an eye bolt that can be adjusted to increase or decrease spring tension. A twisting turn of the housing by a human hand exerts a return force on the hand through the spring with consequent tension being exerted on hand and forearm muscles as long as the housing is continuously gripped.

10 Claims, 5 Drawing Sheets

HAND EXERCISE DEVICE

BACKGROUND OF THE INVENTION

1. Field of the Invention

This invention relates to an exercise device. More particularly, it refers to a device that can be gripped and turned by a person's hand. The device exerts pressure from an internal spring to create tension on various muscles in the hand and forearm.

2. Description of the Prior Art

Many hand exercise devices are well known in the prior art such as shown in U.S. Pat. No. 4,591,151 which describes a device having two cylindrical handle grips. One or more torsion springs coaxially surround a spindle to provide force needed to rotate one of the cylindrical handles. See also U.S. Pat. No. 4,643,417 which describes an exercise device having first and second tubes with hand grip outer surfaces. Frictional resistance retards rotation. Still further, see U.S. Pat. No. 4,695,049 which describes a hand exercise device having first and second handles. A threaded rod is secured to the first handle. A spring exerts force along the threaded rod to produce rotative friction. Also see U.S. Pat. No. 4,193,593 which shows a device having an inner and outer tube. The tubes can be manually grasped and pulled generally axially from a collapsed position to an extended position.

These devices do contribute to the exercise of the hand, but are not specifically designed to exercise and invigorate ligaments binding the joints and fingers such as those ligaments connecting the carpal and metacarpal bones in the dorsal surface of the hand or other ligaments in the palmer surface of the hand. Such action is particularly necessary for older persons to reduce the pain of arthritis or even prevent arthritis from developing. A small portable device that directly exercises these critical hand ligaments is keenly needed.

SUMMARY OF THE INVENTION

I have invented an improved portable hand exercise device for older persons having a tension spring mounted between two mounting brackets attached to a portable pedestal. A cylindrical housing enclosed at each end by an end cap, each having a central through bore, encloses the spring. A mounting sleeve connects one end of the spring to a first mounting bracket and an eye bolt connects the other end of the spring to a second mounting bracket. The eye bolt can be moved by an adjusting nut to exert greater or lessor tension on the spring. Turning the housing by a circular hand motion exerts pressure on the spring which then continues pressure on the hand, wrist and forearm muscles as long as the housing is continuously gripped.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
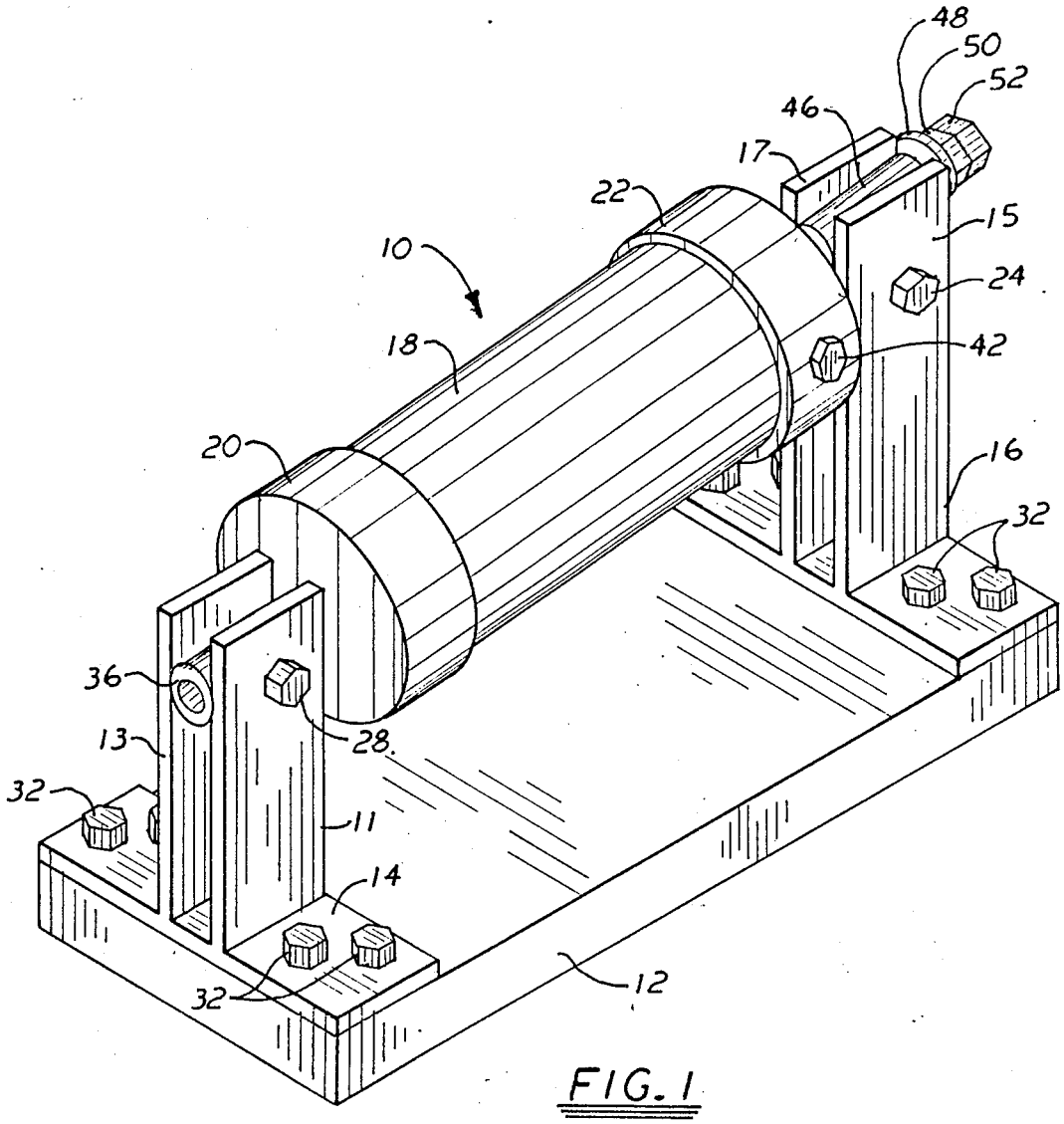
FIG. 1 is a perspective view of the hand exercise device mounted on a pedestal.
Figure 2:
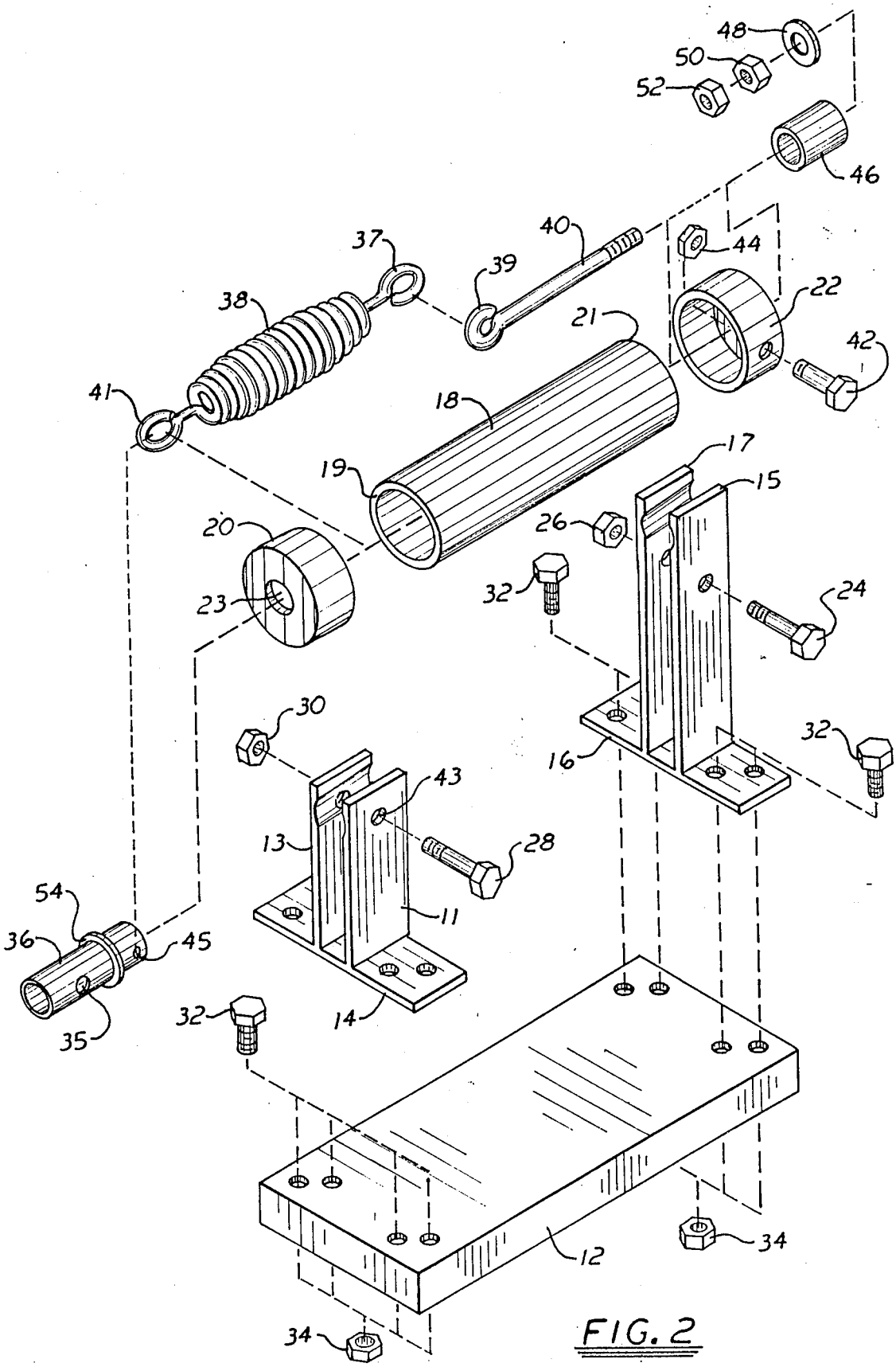
FIG. 2 is an exploded view of the device shown in FIG. 1.
Figure 3:
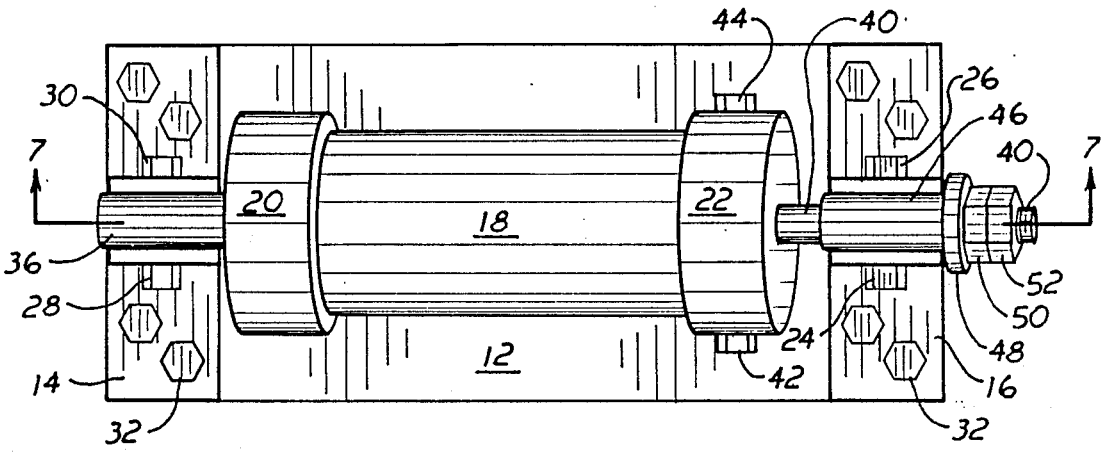
FIG. 3 is a top plan view of the hand exercise device.
Figure 4:
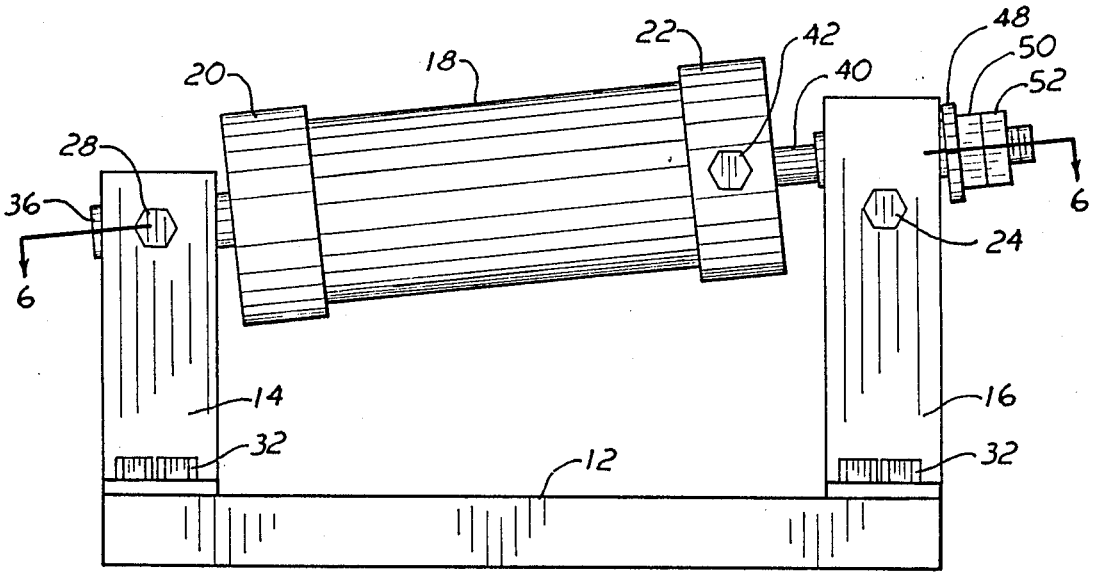
FIG. 4 is a side elevation view of the hand exercise device.
Figure 5:
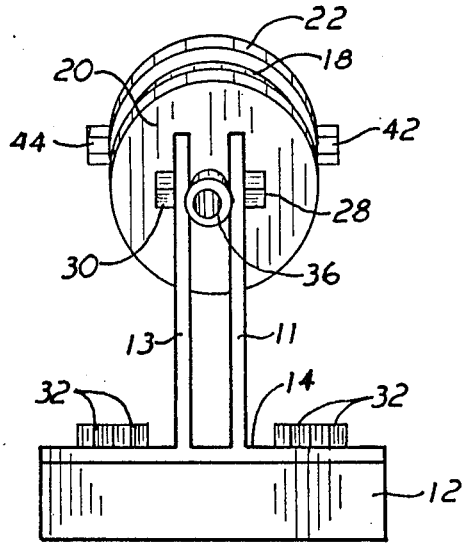
FIG. 5 is a left side end view of the hand exercise device.

Throughout the following detailed descriptions, the same reference numerals refer to the same elements in all figures.

Referring to FIG. 1, the hand exercise device 10 is mounted on a base or pedestal 12 using left U-bracket 14 and righ U-bracket 16. The left U-bracket 14 has a mounting sleeve 36 grasped between the two side members 11 and 13 of the U-bracket 14 and is permanently affixed to the U-bracket 14 by a bolt 28 and nut 30 through hole 43 in bracket 14 and hole 35 in mounting sleeve 36. An eye bolt 40 is enclosed within a spacer sleeve 46 which is grasped by the two upright arms 15 and 17 of mounting bracket 16. The bolt 24 and nut 26 squeeze the arms 15 and 17 of the U-bracket 16 together to securely grasp the spacer sleeve 46.

A washer 48 and nuts 50 and 52 are screwed on one end of the eye bolt 40 distal from a spring 38.

The spring 38 is attached at a first end 37 to the eye portion 39 of the eye bolt 40 and at a second end 41 is aligned with hole 45 in mounting sleeve 36. As the nut 50 is tightened down, the eye bolt will exert additional pressure on spring 38. Nut 52 keeps nut 50 in place.

Figure 7:
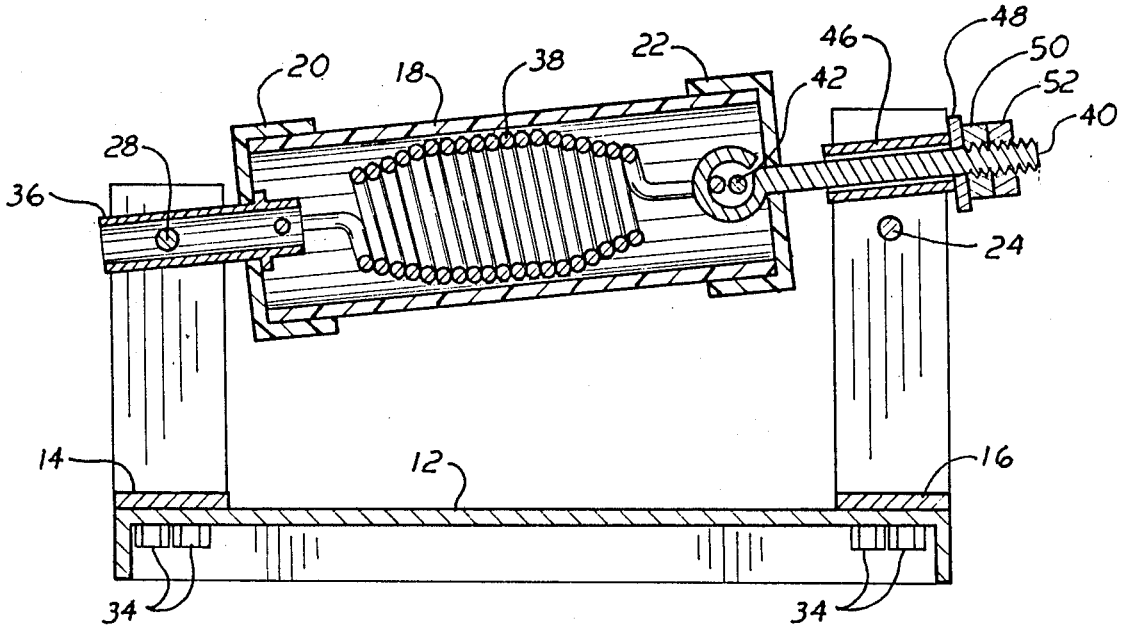
FIG. 7 is a section view along line 7—7 in FIG. 3.
Figure 6:
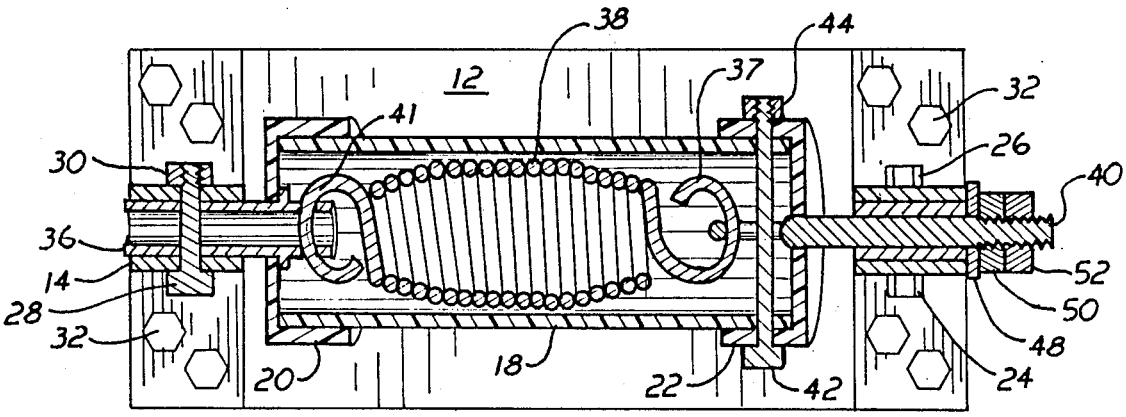
FIG. 6 is a section view along line 6—6 in FIG. 4.
Figure 8:
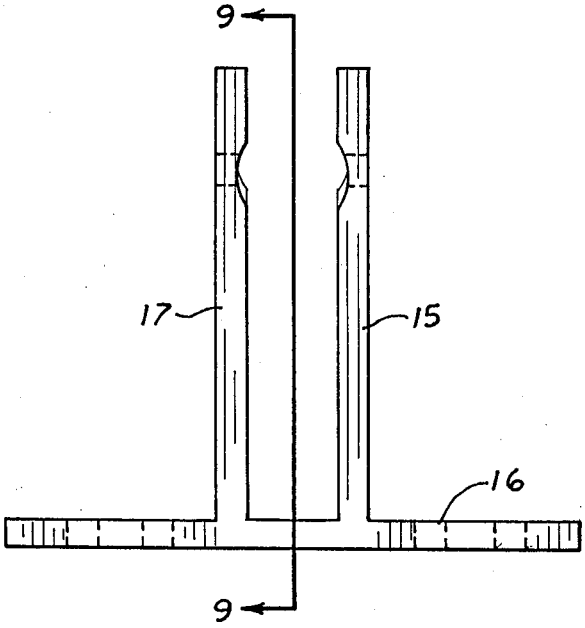
FIG. 8 is a front view of the right side mounting element.
Figure 9:
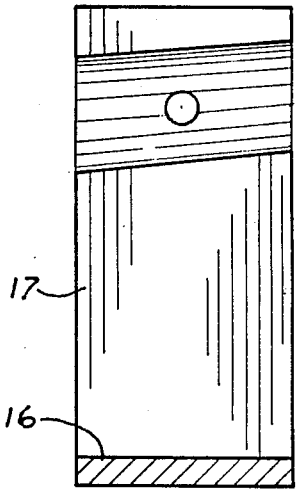
FIG. 9 is a section view along line 9—9 of FIG. 8.

The spring 38 and the portions of mounting sleeve 36 containing the hole 45 and flange 54, together with the eye portion of bolt 40 are enclosed within a cylindrical housing 18. This housing is open at each end 19 and 21. A rear or second end 19 is enclosed by a rear end cap 20 and the front or first end 21 is enclosed by front end cap 22. Each end cap has a central bore hole 23. The integral flange 54 of mounting sleeve 36 abuts the inner surface rear end cap 20 through its bore hole 23. Front end cap 22 receives the eye bolt 40 through its bore hole 23. Front end cap 22 has a through bolt 42 and nut 44 to prevent any movement of the end cap except as the housing 18 is moved. Through bolt 42 passes through eye 39 as seen in FIG. 7. The cylindrical housing 18 is glued to each end cap by an epoxy or other high strength material.

The spacer sleeve 46 allows movement of the eye bolt 40 within the interior of the sleeve and permits its tension to be adjusted by the aforementioned nut 50. The sleeve 46 is held in place by the tension of the upright members of mounting bracket 16 held together by bolt 24 and nut 26. The two mounting brackets 14 and 16 are mounted permanently to the pedestal 12 by bolts 32 and nuts 34 respectively.

The person using the exercise device places the pedestal on his or her lap and twists the cylindrical housing 18 with one hand. The other hand retains the pressure on the spring while the first hand twists further. This process is repeated until the desired twisting force is obtained. Then only one hand at a time need be used and the tube can be twisted back and forth usually at least 12 times. The twisting force should then be exerted in the opposite direction and again repeated about twelve times. Thereafter, the other hand should be used and the same process repeated again in order to complete one exercise cycle.

The pedestal and cylindrical housing of my invention can be made of lightweight aluminum or high strength polymer. In like manner, the brackets can be either aluminum or a high strength polymer. The mounting sleeves, spring and eye-bolts, along with various bolts used throughout the invention are made of stainless steel or other like material capable of withstanding significant tension.

Different shaped brackets and welding of various parts can be employed instead of bolts to make my device. These substitutions are equivalent to the elements and techniques used in my invention and such substitution does not depart from the inventive concept of my invention.

Having thus described the invention, what is claimed and desired to be secured by Letters Patent is:

1. A portable hand exercise device comprising:

a first and second mounting bracket attached to a base, a mounting sleeve fixedly attached to the first mounting bracket, a tubular sleeve held by the second mounting bracket, a rod movably mounted within the sleeve, the rod having a first end in the form of a hook and a threaded second end, the threaded resistance second end held in place by a threaded adjusting element outside the sleeve, a spring connecting the mounting sleeve to the hook on the rod, a cylindrical gripping member housing and enclosing the spring the gripping member being fixedly connected at one end to the hook and spring, while being rotatably attached to the mounting sleeve at the other end, so that a twisting motion on the cylindrical gripping member will cause the spring to increase pressure.

2. The portable hand exercise device according to claim 1 wherein the first and second mounting brackets are U-shaped and are permanently bolted to the base.

3. The portable hand exercise device according to claim 2 wherein a mounting sleeve is bolted to the first mounting bracket and the tubular sleeve is squeezed between the pair of upright members in the second mounting bracket.

4. The portable hand exercise device according to claim 1 wherein the rod is a threaded eye bolt and the threaded resistance adjusting element comprises a threaded nut attached at the threaded second end.

5. The portable hand exercise device according to claim 4 wherein the cylindrical gripping member is open at both ends and the ends are enclosed by a first and second end cap each having a central through bore.

6. The portable hand exercise device according to claim 5 wherein the eye portion of the eye bolt is located adjacent an interior surface of the first end cap and is permanently affixed to the first end cap and to a first end of the spring.

7. The portable hand exercise device according to claim 6 wherein a flange on the mounting sleeve is located adjacent an interior surface of the second end cap and a bore hole in the mounting sleeve is aligned with a second end of the spring and connected to the spring with a bolt and nut.

8. A portable hand exercise device comprising:

a first and second mounting bracket secured to a base, a mounting sleeve fixedly secured to the first mounting bracket, an eye bolt movably held within a tubular spacer sleeve, the spacer sleeve gripped by the second mounting bracket, a spring connecting the mounting sleeve to the eye bolt, a cylindrical gripping member open at a first and second end enclosing the spring, a rear end cap enclosing the second end and a front end cap enclosing the first end of the housing, the rear end cap having a central bore rotatably receiving the mounting sleeve and the front end cap having a central bore receiving the eye bolt, wherein the gripping member is fixedly connected to the eye bolt and spring adjacent the front end, whereby a twisting motion in one direction on the cylindrical gripping member by a human hand causes the spring to increase tension and exert pressure on the hand as long as the gripping member is continuously gripped.

9. A portable hand exercise device according to claim 8 wherein the first mounting bracket is U-shaped and is bolted to the mounting sleeve through a transverse hole and the second mounting bracket is U-shaped with first and second arms squeezing the spacer sleeve by a bolt through a transverse hole in the first and second arms.

10. A portable hand exercise device according to claim 8 wherein the mounting sleeve has an annular flange that abuts an inside surface of the rear end cap and a transverse hole for receiving a bolt to connect to the spring.

* * * * *